US010411357B1

(12) United States Patent
Ashraf et al.

(10) Patent No.: US 10,411,357 B1
(45) Date of Patent: Sep. 10, 2019

(54) ULTRA-WIDEBAND UNIPOLE ANTENNA

(71) Applicant: KING SAUD UNIVERSITY, Riyadh (SA)

(72) Inventors: Muhammad Ahmad Ashraf, Riyadh (SA); Waleed Tariq Sethi, Riyadh (SA); Khaled Issa, Riyadh (SA); Habib Fathallah, Soukra (TN); Saleh Alshebeili, Riyadh (SA)

(73) Assignee: Kind Saud University, Riyadh (SA)

( * ) Notice: Subject to any disclaimer, the term of this patent is extended or adjusted under 35 U.S.C. 154(b) by 0 days.

(21) Appl. No.: 16/259,806

(22) Filed: Jan. 28, 2019

(51) Int. Cl.
*H01Q 9/28* (2006.01)
*H01Q 9/40* (2006.01)

(52) U.S. Cl.
CPC ..... *H01Q 9/40* (2013.01); *H01Q 9/28* (2013.01)

(58) Field of Classification Search
CPC ..... H01Q 9/40; H01Q 9/28; H01Q 13/02
USPC ..... 343/772, 773
See application file for complete search history.

(56) References Cited

U.S. PATENT DOCUMENTS 3,401,387 A 9/1968 Milligan et al.
4,074,268 A * 2/1978 Olson ..... H01Q 3/28 342/399
6,268,834 B1 7/2001 Josypenko
7,286,095 B2 10/2007 Parsche et al.
7,701,396 B2 4/2010 Cohen
D623,633 S 9/2010 Bliss et al.
7,973,732 B2 7/2011 Cohen
8,184,060 B2 * 5/2012 Du ..... H01Q 21/28 343/773
D713,392 S 9/2014 Podduturi
9,634,396 B2 * 4/2017 Yona ..... H01Q 1/48
10,074,909 B2 * 9/2018 Su ..... H01Q 21/205
2004/0233118 A1 * 11/2004 Jocher ..... H01Q 1/36 343/773
2010/0085264 A1 * 4/2010 Du ..... H01Q 9/40 343/772
2010/0194646 A1 8/2010 Cohen
2012/0068903 A1 3/2012 Thevenard et al.
2014/0118209 A1 * 5/2014 Yona ..... H01Q 9/40 343/775
2015/0015447 A1 1/2015 Yona et al.

* cited by examiner

*Primary Examiner* — Dameon E Levi
*Assistant Examiner* — Jennifer F Hu
(74) *Attorney, Agent, or Firm* — Richard C. Litman

(57) ABSTRACT

The ultra-wideband unipole antenna is a variant on a monocone antenna, including a plurality of electrically conductive rods that act as a parallel inductive-capacitive (L-C) network for improving the impedance match between the radiating element of the antenna and the antenna's feed. An electrically conductive conical surface having a vertex end and a base end acts as the radiating element. The vertex end is positioned adjacent to, and spaced apart from, a ground plane plate. Each electrically conductive rod has opposed first and second ends, the first end being secured to the electrically conductive conical surface, and the second end being secured to the ground plane plate. A coaxial cable feed line has a center conductor and an outer conductor. The center conductor is in electrical communication with the vertex end of the electrically conductive conical surface, and the outer conductor is in electrical communication with the ground plane plate.

6 Claims, 2 Drawing Sheets

ULTRA-WIDEBAND UNIPOLE ANTENNA

BACKGROUND

1. Field

The disclosure of the present patent application relates to multiband antennas, and particularly to an ultra-wideband unipole antenna that is a modified monocone.

2. Description of the Related Art

FIG. 2 shows a conventional prior art monocone antenna 100, which is formed from a conical surface 114 defined by a vertex end 116 and a base end 118, the base end 118 having a cylindrical surface 112 extending therefrom. The cylindrical surface 112 extends the length of conical surface 114 for the purpose of lowering its low frequency cutoff. The vertex end 116 is positioned adjacent a ground plane plate 120. In the example shown, the ground plane plate 120 may be part of the skin of an aircraft to which the monocone antenna 100 is mounted. A center conductor 122 of a coaxial cable 124 is connected to the vertex end 116 to feed the antenna. The outer conductor 126 of the coaxial cable 124 is connected to the ground plane 120. The vertex end 116 is adjacent to, but spaced apart from, the ground plane plate 120.

The antenna pattern of the monocone antenna 100 is substantially omnidirectional on the side of the ground plane plate 120 facing the conical surface 114. The functionality of the monocone antenna 100 is limited with regard to diverse usage, since the height and the cone angle of the monocone define the low frequency cutoff, i.e., by having a fixed construction with a fixed geometry, the monocone antenna 100 has a predefined set low frequency cutoff. Additionally, the monocone antenna 100 includes no inherent design features for matching the impedance between the antenna's radiating element (i.e., the conical surface 114) and the antenna's feed. Thus, an ultra-wideband unipole antenna solving the aforementioned problems is desired.

SUMMARY

The ultra-wideband unipole antenna is a variant on a monocone antenna, particularly including a plurality of electrically conductive rods that act as a parallel inductive-capacitive (L-C) network for improving the impedance match between the radiating element of the antenna and the antenna's feed. The ultra-wideband unipole antenna includes an electrically conductive conical surface having a vertex end and a base end, which acts as the antenna's radiating element. The vertex end of the electrically conductive conical surface is positioned adjacent to, and spaced apart from, a first surface of a ground plane plate.

As noted above, a plurality of electrically conductive rods are provided to serve as a parallel inductive-capacitive (L-C) network for improving the impedance match between the radiating element of the antenna and the antenna's feed. Each electrically conductive rod has opposed first and second ends, the first end being secured to the electrically conductive conical surface adjacent the base end thereof, the second end being secured to the first surface of the ground plane plate.

Each electrically conductive rod has a first portion adjacent the first end, a second portion adjacent the second end, and a central portion positioned therebetween. The first portion and the second portion each have diameters associated therewith that are greater than a diameter of the central portion.

A coaxial cable has a center conductor serving as the antenna's feed, and an outer conductor. The center conductor is in electrical communication with the vertex end of the electrically conductive conical surface, and the outer conductor is in electrical communication with the ground plane plate.

These and other features of the present invention will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
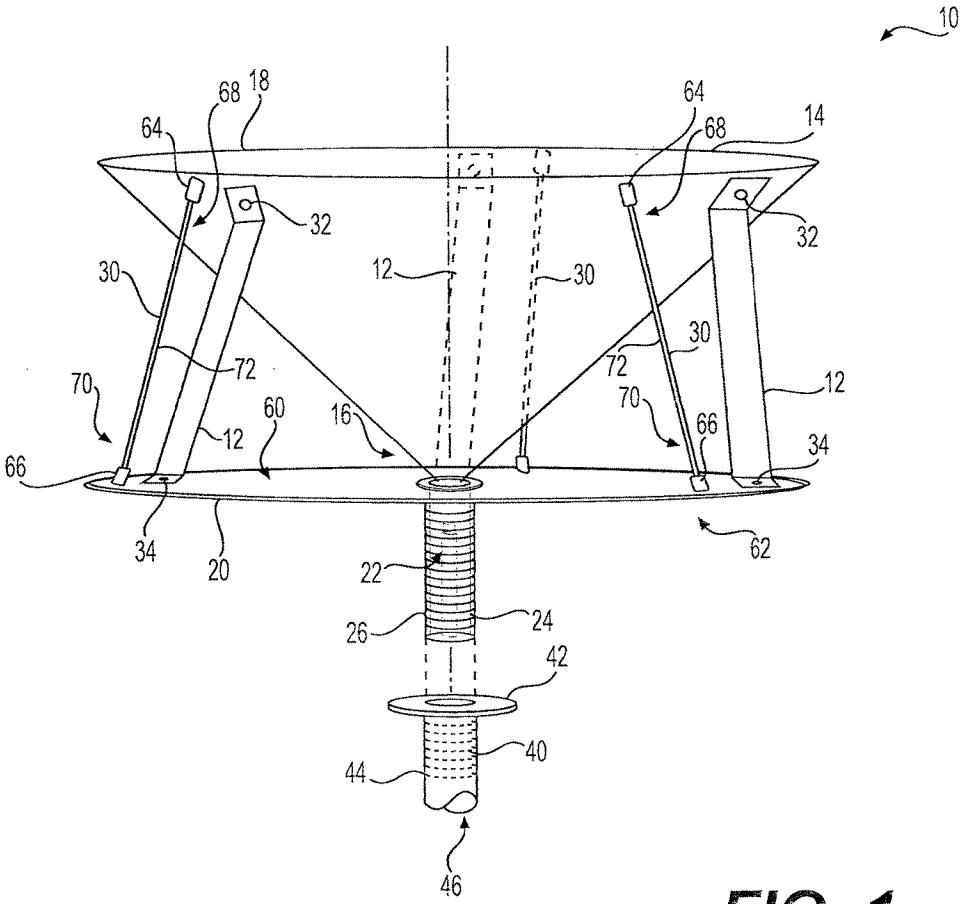
FIG. 1 is a perspective view of an ultra-wideband unipole antenna.
Figure 2:
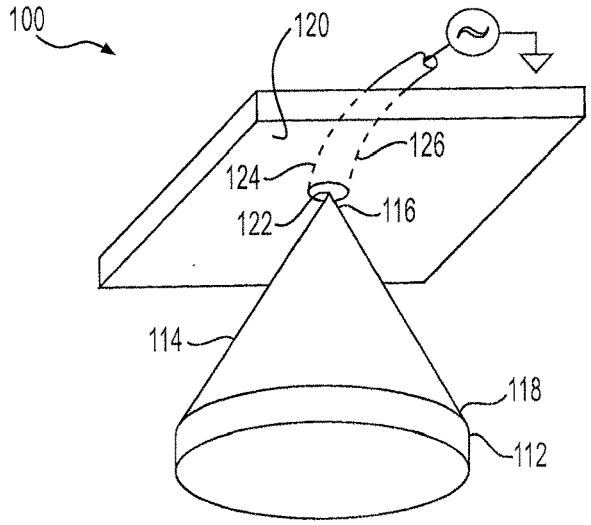
FIG. 2 (PRIOR ART)
FIG. 2 is a perspective view of a conventional prior art monocone antenna.

The ultra-wideband unipole antenna 10 is a variant on a monocone antenna, particularly including a plurality of electrically conductive rods 30 that act as a parallel inductive-capacitive (L-C) network for improving the impedance match between the radiating element of the antenna and the antenna's feed. The ultra-wideband unipole antenna 10 includes an electrically conductive conical surface 14 having a vertex end 16 and a base end 18, the conical surface 14 acting as the antenna's radiating element. The vertex end 16 of the electrically conductive conical surface is positioned adjacent to, and spaced apart from, a first surface 60 of a ground plane plate 20. In FIG. 1, the ground plane plate 20 is shown as being circular. However, it should be understood that the circular ground plane plate 20 is shown for exemplary purposes only, and the ground plane plate 20 may have any suitable configuration and relative dimensions.

As noted above, a plurality of electrically conductive rods 30 are provided to serve as a parallel inductive-capacitive (L-C) network for improving the impedance match between the radiating element 14 of antenna 10 and the antenna's feed. Each electrically conductive rod 30 has opposed first and second ends 64, 66, respectively, the first end 64 of each rod 30 being secured to the electrically conductive conical surface 14 adjacent the base end 18, and the second end 66 of each rod 30 being secured to the first surface 60 of the ground plane plate 20. As shown, the second ends 66 of the plurality of electrically conductive rods 30 may be secured to the first surface 60 of the ground plane plate 20 adjacent the peripheral edge of the ground plane plate 20.

Each electrically conductive rod 30 has a first portion 68 adjacent the first end 64, a second portion 70 adjacent the second end 66, and a central portion 72 extending therebetween. The first portion 68 and the second portion 70 each have diameters that are greater than the diameter of the central portion 72. The diameter of the first and second portions 68, 70 may, for example, be equal to twice the diameter of the central portion 72.

In FIG. 1, three electrically conductive rods 30 are shown spaced 120° apart with respect to the ground plane plate 20 and the base end 18 of the electrically conductive conical surface 14. However, it should be understood that the three electrically conductive rods 30 are shown for exemplary purposes only, and that any suitable number of rods 30 may be used. Additionally, each of the first and second portions 68, 70 may be cylindrical, as shown, with heights of approximately 6 mm and diameters of approximately 8 mm. It should be understood that the rods 30 may have any suitable type of shape. The rods 30 may, alternatively, have hexagonal cross sections, preferably with diameters not exceeding 2 mm.

It should be understood that the electrically conductive conical surface 14, the electrically conductive rods 30, and the ground plane plate 20 may be formed from any suitable type of electrically conductive material, such as copper, aluminum or brass sheet material, as is well known in the field of antenna construction. Further, it should be understood that the electrically conductive conical surface 14 and the ground plane plate 20 may be enclosed by a wire cage and/or may be formed from wire mesh, as is also well known in the field of antenna construction.

Additionally, a plurality of electrically non-conductive struts 12 may be provided for adding structural stability to the electrically conductive conical surface 14. Each electrically non-conductive strut 12 has opposed first and second ends 32, 34, respectively, the first ends 32 being secured to the electrically conductive conical surface 14 adjacent the base end 18, and the second ends 34 being secured to the first surface 60 of the ground plane plate 20. The electrically non-conductive struts 12 may be secured to the electrically conductive conical surface 14 and the ground plane plate 20 by any suitable type of screws, bolts or the like.

The center conductor 22 of the coaxial cable 24 feed line is in electrical communication with the vertex end 16 of the electrically conductive conical surface 14, and the outer conductor 26 of the coaxial cable 24 is in electrical communication with the ground plane plate 20 through direct contact with the lower surface 62. As shown in FIG. 1, a cable fixing member 40 may be provided in the form of a hollow tubular portion 44 with an annular flange 42. The coaxial cable 24 is received through the central passage 46 of the hollow tubular portion 44 for securing the coaxial cable 24. Alternatively, the cable fixing member 40 may be used as a mounting structure, such that a mounting surface, such as the wall of an airplane or the like, is clamped between the annular flange 42 and the second surface 62 of the ground plane plate 20.

The vertex end 16 serves as the feed point of the electrically conductive conical surface 14, and the feed point has a first impedance associated therewith. The feed from coaxial cable 24 has a second impedance associated therewith, and the first and second impedances should be mutually well matched in order to facilitate efficient energy transfer therebetween to allow broadband operation of the antenna 10. The first impedance of the feed point 16 is well matched to the second impedance of the feed 24 due to the provision of electrically conductive rods 30 connecting the broadband electrically conductive conical surface 14 and the ground plane plate 20.

In addition to the L-C matching network, the electrically conductive rods 30 also act as a resonant structure to improve the radiation performance of the antenna 10. By way of example, the broadband electrically conductive conical surface 14 can exhibit stable radiation characteristics over a bandwidth of around 110%. The additional resonance the three electrically conductive rods 30 provide can improve the realized gain value more than 2 dB when compared to a similar type of broadband radiating antenna element. The electrically conductive rods 30 also act as a matching network and can be used to provide a voltage standing wave ratio (VSWR) of 1.5:1 over the 110% bandwidth.

It should be understood that the various design dimensions of the electrically conductive conical surface 14, the ground plane plate 20, and the electrically conductive rods 30 can be varied, allowing the ultra-broadband vertically polarized antenna 10 to be optimized for different radio-frequency (RF) bands. The design parameters are a function of the minimum operational frequency of the antenna 10, which may start at approximately 380 MHz. Thus, for a minimum frequency of 9 GHz, the antenna 10 can be efficiently used for millimeter-wave (MMW) applications up to 30 GHz.

Figure 3:
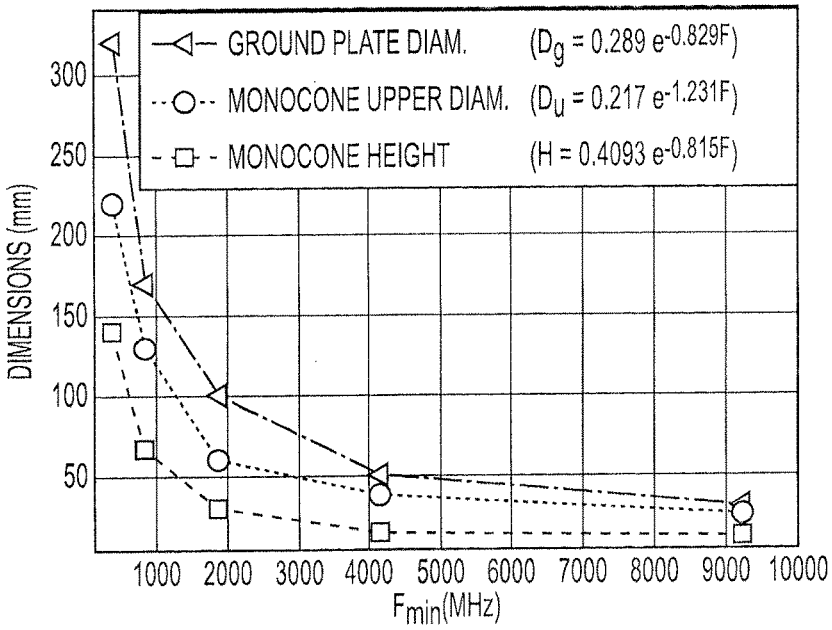
FIG. 3 is a graph illustrating design parameters of the ultra-wideband unipole antenna as functions of minimum operating frequency ($F_{min}$).

The electrically conductive conical surface 14 acts as a broadband radiator, preferably radiating an omni-directional radiation pattern. FIG. 3 shows the critical antenna design dimensions, illustrated with respect to frequency. In FIG. 3, the parameters are the ground plate diameter (i.e., for a circular ground plane plate, this is the diameter of plate 20), $D_g$; the upper diameter of the monocone radiating element (i.e., the diameter of the base end 18), $D_u$; and the height of the monocone radiating element (i.e., the height of the electrically conductive conical surface 14), H. The antenna 10 is expected to outperform over the multi-bands with excellent broadband matching (VSWR 1.5:1) and a realized gain more than 5 dBi at the lowest frequency of operation. It is recognized that the antenna parameters' values decay exponentially with respect to higher frequencies, thus the governing mathematical expressions, shown in FIG. 3, are estimated to generalize the design of the high performance antenna parameters.

It is to be understood that the ultra-wideband unipole antenna is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. An ultra-wideband unipole antenna, comprising:

an electrically conductive conical surface having a vertex end, a base end, a first surface, and a second surface;

a ground plane plate having opposed first and second surfaces, the vertex end of the electrically conductive conical surface being positioned adjacent to, and spaced apart from, the first surface of the ground plane plate;

a plurality of electrically conductive rods, each of the rods having opposed first and second ends, the first end of each of the rods being secured to the electrically conductive conical surface adjacent the base end thereof, the second end of each of the rods being secured to the first surface of the ground plane plate, each of the rods having a first portion adjacent the first end, a second portion adjacent the second end, and a central portion positioned therebetween, the first portion and the second portion each having a diameter greater than the central portion; and a coaxial cable having a center conductor and an outer conductor, the center conductor being in electrical communication with the vertex end of the electrically conductive conical surface, and the outer conductor being in electrical communication with the ground plane plate.

2. The ultra-wideband unipole antenna as recited in claim 1, further comprising a plurality of electrically non-conductive struts, each of the struts having opposed first and second ends, the first ends being secured to the electrically conductive conical surface, and the second ends being secured to the ground plane plate.

3. The ultra-wideband unipole antenna as recited in claim 1, further comprising a cable fixing member having a hollow tubular portion and an annular flange.

4. The ultra-wideband unipole antenna as recited in claim 1, wherein the first portion and the second portion of each said electrically conductive rod is equal in diameter.

5. The ultra-wideband unipole antenna as recited in claim 4, wherein the first and second portions of each said electrically conductive rod each have a diameter twice the diameter of the central portion.

6. The ultra-wideband unipole antenna as recited in claim 1, wherein the second ends of the plurality of electrically conductive rods are secured to the ground plane plate adjacent a peripheral edge thereof.

* * * * *